United States Patent [19]

Cassan

[11] Patent Number: 4,730,961

[45] Date of Patent: Mar. 15, 1988

[54] EDGING MACHINE PREFERABLY FOR CHAINS

[76] Inventor: Marisa Cassan, Via Lago, 13 - Arcugnano (Vicenza), Italy

[21] Appl. No.: 809,562

[22] Filed: Dec. 16, 1985

[30] Foreign Application Priority Data

Dec. 18, 1984 [IT] Italy ..... 63392/84[U]

[51] Int. Cl.[4] ..... B23C 3/00

[52] U.S. Cl. ..... 409/166; 51/118; 409/211

[58] Field of Search ..... 409/165, 166, 192, 211; 82/2 A; 51/118, 131.1

[56] References Cited

U.S. PATENT DOCUMENTS

| | | | |
|---|---|---|---|
| 684,362 | 10/1901 | Flora | 51/118 |
| 3,823,627 | 7/1974 | Scharten | 82/4 A X |
| 3,859,756 | 1/1975 | Zerbola | 51/118 |

*Primary Examiner*—Z. R. Bilinsky

*Attorney, Agent, or Firm*—Ladas & Parry

[57] ABSTRACT

The present patent of invention relates to an edging machine that permits the machining of two opposite sides of a chain even contemporaneously. The machine consists essentially of a vice (4) for gripping and feeding the chain, the said vice showing a central supporting disc (16) which is journalled on a rotating shaft (3) and cooperates with circular plates (10, 15) presenting opposed inclinations. The machine is provided on its upper part with a stirrup (19) with slots (20) shaped like arcs of circle, in which edging means (21) are inserted and regulated.

The arrangement and adjustment of both the gripping and feeding vice (4), and edge elements (21) allow both opposite sides of a chainlet, or single sides of two chainlets, to be machined quickly, precisely and contemporaneously according to the wished angle and depth of engraving.

6 Claims, 2 Drawing Figures

EDGING MACHINE PREFERABLY FOR CHAINS

The present patent relates to an edging machine with double body, a table for contemporaneously and in a continuous manner machining either the two sides of a single chain, or two sides of two different chains by means of engraving and supporting devices independent and adjustable.

It is well-known that the edging machines for engraving chains or similar objects usually consisted of a supporting device or vice on which a chain was inserted. The edging was carried out on both sides of the machined object by means of a milling element particularly shaped and suitable for being applied on the rim of the chain itself.

However, since the thickness of the object to be machined was very fine, the engraving or edging, carried out by means of the aforesaid devices, was greatly imperfect. Moreover, a comparatively long machining time was necessary because the object went on very slowly. The purpose of the present invention consists in providing an edging machine in which the above-mentioned disadvantages are eliminated, the machine permitting more sides of the same chain to be contemporaneously faceted.

In fact, the invention refers to an edging-faceting machine, preferably for chains or the like, characterized in the fact of providing a supporting device in the inner part of which a rotating transmission-shaft supports means of gripping and feeding for the chain or the like to be machined; the said gripping and feeding means consist essentially of cylindrical elements, which are joined with the said shaft and arranged on an axis slightly inclined in comparison with the said shaft; on the said cylindrical elements there are ring bearing supports on which further cylindrical bodies rotate; the said cylindrical bodies are coupled with circular plates acting as a vice; the circular plates are separated from a supporting disc, which is perpendicular to the said shaft and has the same axis of rotation of the shaft; an element is applied on the upper part of the gripping means and supports a stirrup which is provided with slots shaped like arcs of circle, which house and support edging elements.

The invention will be better understood from the following description and annexed table of drawing, in which.

Figure 1:
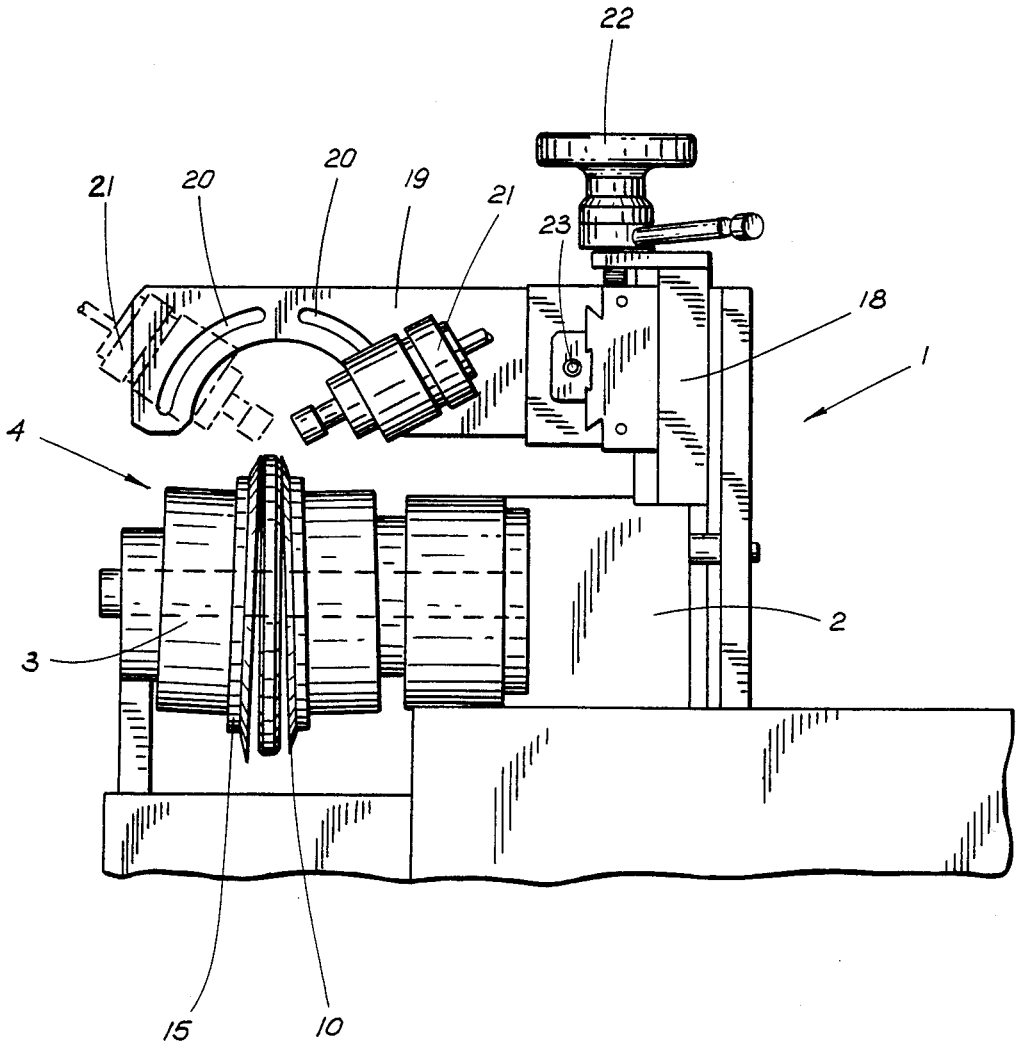
FIG. 1 shows a schematic view of the edging machine as a whole.
Figure 2:
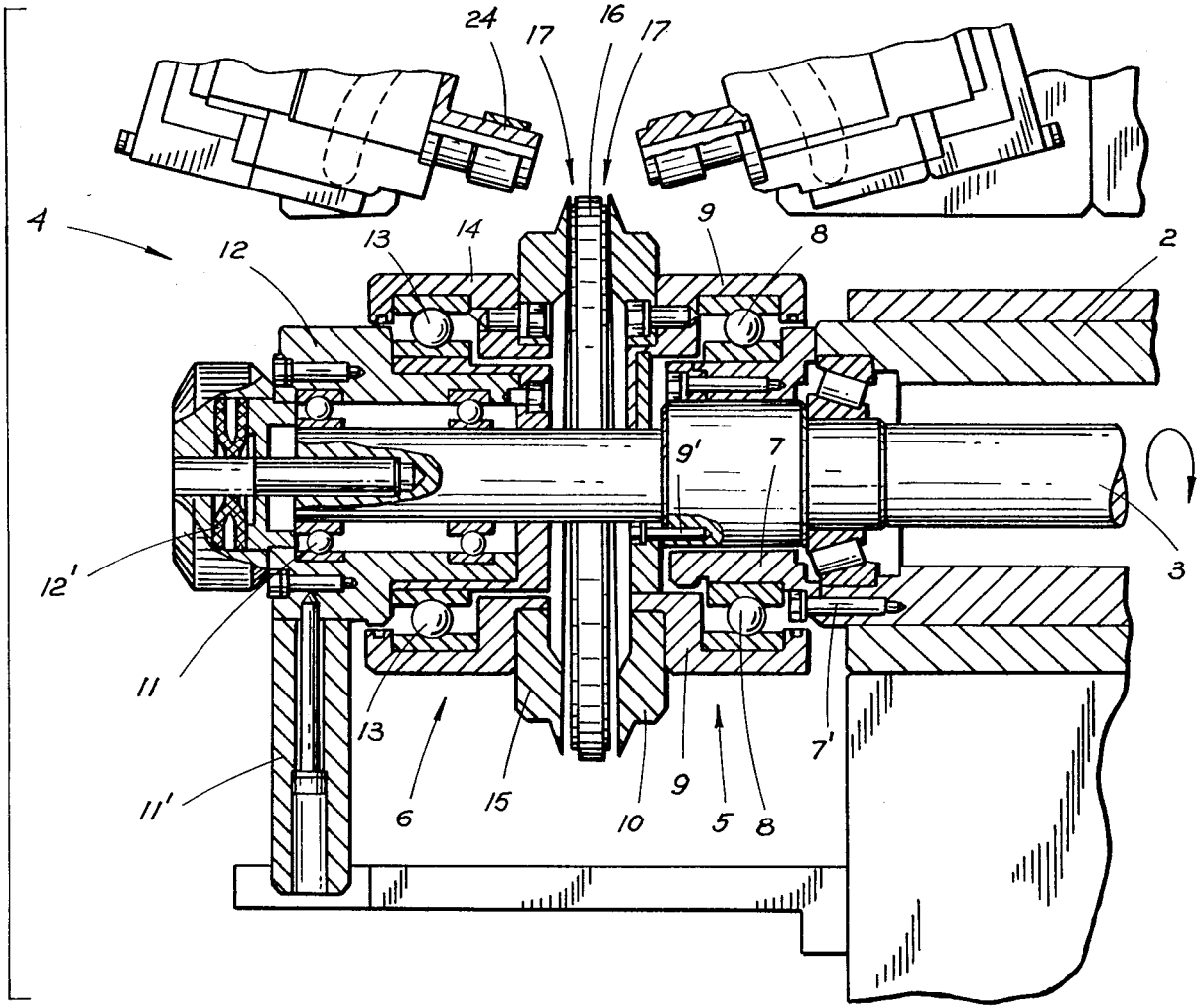
FIG. 2 shows a detail of the vice supporting the chain.

In the table of drawing, numeral 1 denotes, generally, an edging machine for chains or the like. The said edging machine consists essentially of a bearing 2 in the inner part of which a shaft 3 rotates. This shaft is driven by a conventional motor and supports the gripping and feeding elements 4 for the chains to be machined.

Adjusting and shifting elements for faceting means (described below) are positioned on the upper part of the bearing 2.

The gripping and feeding elements 4 are formed by two rotating parts 5 and 6 opposite each other and mounted on the shaft 3.

The part 5 consists essentially of a cylindrical body 7 fixed to the aforesaid bearing 2 and slightly inclined in comparison with the axis of the shaft 3 passing through the body 7. The body 7 is fixed to bearing 2 at 7'. A ball bearing 8 is mounted on the cylindrical body 7. A further body 9 rotates on the said bearing 8. This body 9 is driven by means of the shaft 3 via connection 9' and supports a circular plate 10 having a border which is blunted. The part 6 is specularly opposed to the part 5 and is provided with ball bearing 11 on which a cylindrical body 12 rests inclined with respect to the axis of the shaft 3 at an angle complementary to a body 7. A further ball bearing 13 is provided on the body 12. A cylindrical element 14 rotates on this ball bearing 13 and is joined with a plate 15. A disc 16 is interposed between the two flat surfaces of the plates 10 and 15 and is provided along its circumference with seats 17, the chain to be machined being positioned and kept in the seats in order to be advanced.

The vice as a whole may be adjusted and kept together by means of a usual screw which presses against a 12'. The body 12 is locked onto the shaft 3 by means of an arm 11'.

The particular disposition of the described elements allows the machined chain to be hold only on the upper part of the vice, and consequently the lower part is let free. On this lower part it is therefore possible to continuously feed further chain without having to stop the machining for drawing out the chain from the vice. The upper part of the edging machine consists of an element 18 on which a stirrup 19 is positioned by means of a slide 23. The stirrup 19 is provided with slots 20 shaped like arcs of circle.

Faceting or edging elements 21 are inserted and supported in the said slots and are provided with diamond cutting heads which carry out the machining. The faceting or edging elements are driven by means of suitable motors, for instance electric or pneumatic.

The disposition of the stirrup 19 and the shape of the slots 20 permit the edging elements 21 to be shifted along arcs of circle, the centre being the engraving point. Moreover, spindles 24 of the elements 21 may be shifted along their axes of rotation. One advantage of such a system is that, besides adjusting the edging elements, it is also possible to regulate the whole upper body provided with the engraving means by transversally shifting the upper body on a slide 23, or by vertically shifting the same by means of a wheel 22.

All these adjustments and the presence of two opposite engraving elements permit a perfect machining in a continuous manner of the chain to be edged, even if the thickness is very fine. Accordingly, a great number of engraving angles are possible, in fact it is sufficient to vary both the vice and the engraving device according to the necessities.

Moreover, a stop element is provided for permitting the upper supporting body to always be brought again in a predetermined position, also after shiftings due for instance to the insertion of new chains in the plates 10 and 15.

I claim:

1. A machine for edging chains, chainlets or similar articles by machining two chain sides simultaneously comprising:

a vice for gripping and feeding a chain to be edged including (a) a shaft;

(b) first and second fixed cylindrical bodies rotatably mounted on said shaft at an angle inclined with respect to an axis of said shaft;

(c) third and fourth cylindrical bodies rotatably mounted on said first and second bodies, respectively, one of said third and fourth bodies being connected to said shaft for rotation therewith;

(d) first and second plates mounted on a side of said third and fourth bodies, respectively, and opposing each other on said shaft, said plates being mounted to said third and fourth bodies at an angle complementary to said inclination;

(e) a disc mounted on said shaft substantially perpendicular to said axis, said disc having a circumferential seat for holding said chain, said first and second plates contacting said disc at one portion of its periphery and not at other portions; and (f) means for urging said first and second bodies together, whereby the rotation of one of said third and fourth bodies and its associated plate is transferred through said disc to the other of said third and fourth bodies and its associated disc to grip and feed said chain;

machining means for machining said chain including a stirrup positioned above said vice substantially at the point where said plates contact said disc, said stirrup having arc shaped slot which support edging elements.

2. The edging machine according to claim 1, wherein said seat comprises a bearing slot or seat along both sides of a rim of said disc.

3. The edging machine according to claim 1, wherein said stirrup is adjustable to move said machining means nearer to or further away from said vice.

4. The edging machine according to claim 3, wherein said machining means is slidable on said stirrup in a direction parallel to said axis of said shaft.

5. The edging machine according to claim 1, wherein said edging elements comprise motor-driven cutting heads and can be shifted along said arc shaped slots.

6. The edging machine according to claim 5, wherein said cutting heads can be shifted along their axes of rotation.

* * * * *